US006981635B1

(12) United States Patent
Hughs-Baird et al.

(10) Patent No.: US 6,981,635 B1
(45) Date of Patent: Jan. 3, 2006

(54) GAMING DEVICE HAVING INTERACTING SYMBOLS

(75) Inventors: Andrea C. Hughs-Baird, Reno, NV (US); Jason D. Kremer, Reno, NV (US); Brian D. Swift, Sparks, NV (US)

(73) Assignee: IGT, Reno, NV (US)

( * ) Notice: Subject to any disclaimer, the term of this patent is extended or adjusted under 35 U.S.C. 154(b) by 577 days.

(21) Appl. No.: 09/686,308

(22) Filed: Oct. 11, 2000

(51) Int. Cl.
*G06F 17/00* (2006.01)
*A63F 13/10* (2006.01)

(52) U.S. Cl. ..... 235/375; 463/20; 273/143 R

(58) Field of Classification Search ..... 235/375, 235/376; 902/23; 273/138.1, 142 R, 143 R; 463/11, 16, 20, 6
See application file for complete search history.

(56) References Cited

U.S. PATENT DOCUMENTS

| | | | | |
|---|---|---|---|---|
| 4,695,053 A | | 9/1987 | Vazquez, Jr. et al. | 463/18 |
| 5,449,173 A | | 9/1995 | Thomas et al. | 273/143 R |
| 5,769,716 A | | 6/1998 | Saffari et al. | |
| 5,833,536 A | | 11/1998 | Davids et al. | |
| 5,997,400 A | | 12/1999 | Seelig et al. | 463/20 |
| 5,997,401 A | | 12/1999 | Crawford | 463/20 |
| 6,033,307 A | | 3/2000 | Vancura | 463/20 |
| 6,056,642 A | | 5/2000 | Bennett | 463/20 |
| 6,059,289 A | | 5/2000 | Vancura | 273/143 R |
| 6,089,976 A | | 7/2000 | Schneider et al. | 463/16 |
| 6,095,921 A | * | 8/2000 | Walker et al. | 273/138.2 |
| 6,142,875 A | | 11/2000 | Kodachi et al. | 463/20 |
| 6,290,600 B1 | * | 9/2001 | Glasson | 273/143 R |
| 6,319,124 B1 | * | 11/2001 | Baerlocher et al. | 273/138.1 |
| 6,558,254 B2 | * | 5/2003 | Baelocher et al. | 463/20 |
| 6,565,433 B1 | * | 5/2003 | Baelochere et al. | 463/20 |

FOREIGN PATENT DOCUMENTS

WO WO 9732285 9/1997

OTHER PUBLICATIONS

Description of Traveling Symbols written by IGT, available in Sep. 1999.
South Park Advertisement written by IGT, available in Sep. 1999.
Ghoulish Gamble Advertisement written by Strictly Slots, published prior to Sep. 2000.
Description of Expanding Symbol written by IGT, available in Sep. 1999.
Mystery Mine Advertisement written by Konami Australia Pty. Ltd, published prior to Jan. 1999.
Cash Chameleon Advertisement written by Aristocrat, published prior to Jan. 2000.
Description of Animating Symbol Features in Gaming Machine written by IGT, published prior to Jan. 2000.
Description of Gaming Machine with Animating Symbols written by IGT, published prior to Jan. 2000.

* cited by examiner

*Primary Examiner*—Daniel St. Cyr
(74) *Attorney, Agent, or Firm*—Bell, Boyd & Lloyd, LLC

(57) ABSTRACT

The present invention relates to a gaming device and method which includes interacting symbols. Wherein the game exhibits the interaction between the two symbols using a display device and awards the player with a credit or bonus value.

45 Claims, 13 Drawing Sheets

GAMING DEVICE HAVING INTERACTING SYMBOLS

This application is related to the following commonly-owned co-pending patent applications: "GAMING DEVICE WITH TRAVELING REEL SYMBOLS," U.S. Ser. No. 09/606,928, "GAMING DEVICE WITH MULTI-PURPOSE REELS," U.S. Ser. No. 10/023,268, "GAMING DEVICE WITH MOVING SCREEN SIMULATION," U.S. Ser. No. 09/625,884, "GAMING DEVICE WITH SIGNIFIED REEL SYMBOLS," U.S. Ser. No. 10/990,484, "GAMING DEVICE HAVING TOUCH ACTIVATED ALTERNATING OR CHANGING SYMBOL," U.S. Ser. No. 09/602,331, "GAMING DEVICE PROVIDING TOUCH ACTIVATED SYMBOL INFORMATION," U.S. Ser. No. 09/680,349, "GAMING DEVICE HAVING A CHANGEABLE OBJECT," U.S. Ser. No. 09/680,111, "GAMING DEVICE WITH TRAVELING REEL SYMBOLS;" U.S. Ser. No. 09/689,197, and "GAMING DEVICE HAVING A SYMBOL COVERING FEATURE," U.S. Ser. No. 09/684,275.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having interacting symbols.

BACKGROUND OF THE INVENTION

Gaming machines currently exist with mechanical reels having symbols thereon, video reels having symbols and bonus schemes in which a player has one or more opportunities to choose a particular symbol from a group of symbols to receive credit or bonus values.

Many gaming devices with a variety of symbols are well known. Since players are seeking more entertainment and enjoyment, it is desirable to provide players with new gaming devices where the players have an opportunity to receive winning payouts and are entertained at the same time.

SUMMARY OF THE INVENTION

The present invention provides a gaming device and method which provides players an award associated with interacting symbols on reels of a gaming device. For purposes of this application, the term "interacting" includes visually or audibly displaying one symbol influencing or acting in conjunction with one or more other symbols.

The gaming scheme of the present invention provides a player with a plurality of symbols on a plurality of video or virtual reels. When a player obtains two or more interacting symbols, the game exhibits an interaction between or among the symbols using the display device. In operation, the player initiates spinning the video reels, generally by placing a wager. If the reels display at least two (preferably related and adjacently positioned) symbols on the same horizontal row, the game exhibits an interaction between the symbols and the game preferably awards the player with a credit award or bonus value.

If the present invention is used in a bonus scheme of a gaming device, the game preferably enables the player to select one or more of the interacting symbols. In such a bonus game, preferably certain of the symbols are each related to at least one other symbol and will display an interaction if properly selected. In one embodiment, if the player selects two non-interacting symbols, the bonus round terminates. As long as the player avoids the non-interacting symbols, the game continues and the player chooses another selection. If the player chooses additional interacting symbols, the game preferably awards the player with another award. This process continues until the player ultimately chooses non-interacting symbols or until the player chooses all the related symbols in the bonus round. It should also be appreciated that the gaming device could select a first symbol and prompt the player to select another symbol and display the interaction between the symbols, if appropriate.

The symbols may be represented by characters which appear in the squares, including people, phrases and animals. In one preferred embodiment, the symbols consist of characters in pairs or threes. Characters which are related to one another are preferably paired with one another.

It is therefore an object of the present invention to provide a gaming device which includes interacting symbols.

Another object of the present invention is to provide a gaming device with a gaming scheme which provides a reward for obtaining symbols that interact.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
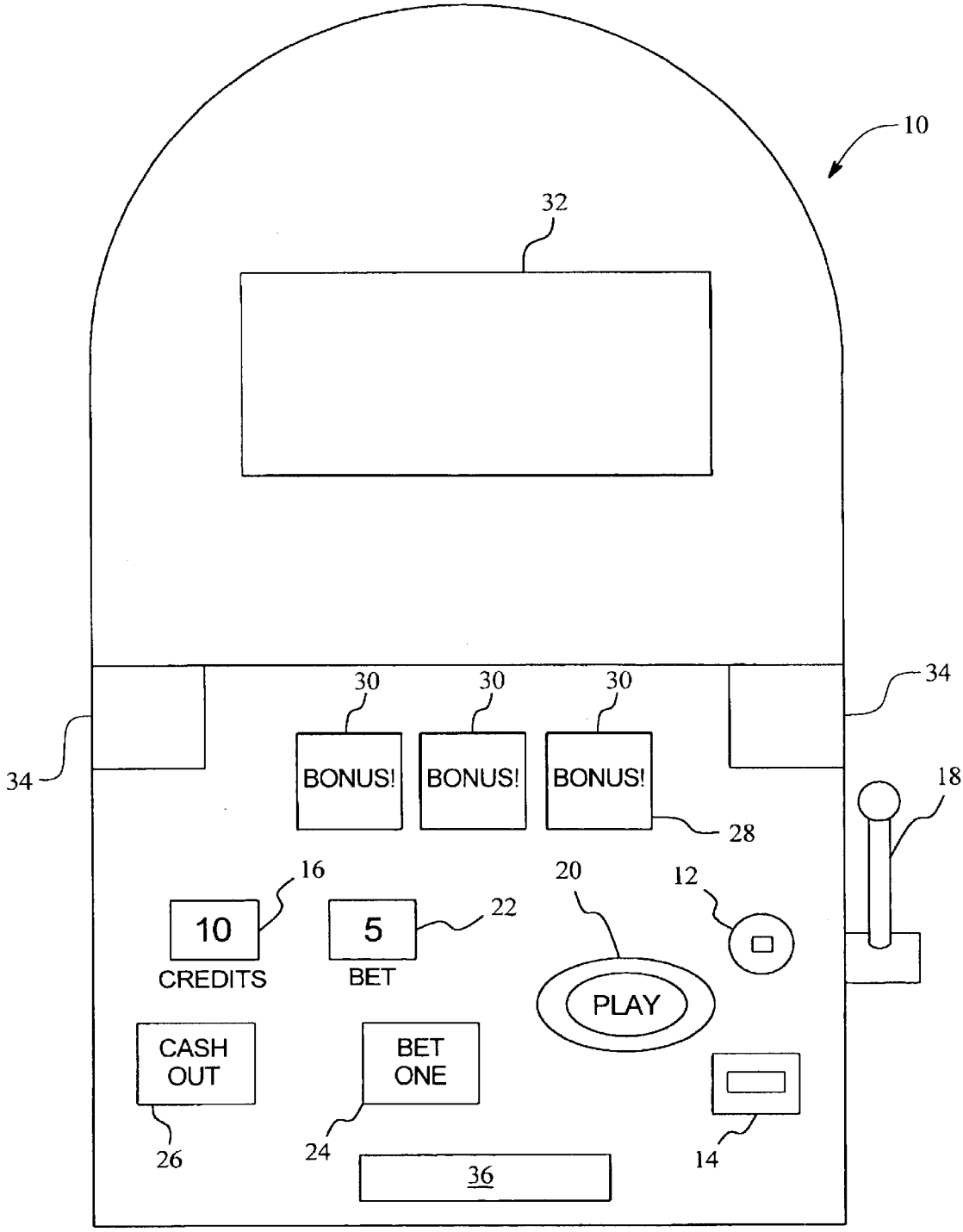
FIGS. 1A and 1B are front plan views of two embodiments of the gaming device of the present invention.

Referring now to the drawings, a gaming device 10 of one embodiment of the present invention, which is preferably a slot machine having the controls, displays and features of a conventional slot machine is generally illustrated. Gaming device 10 is constructed so that a player can operate gaming device 10 while standing or sitting. However, it should be appreciated that gaming device 10 can be constructed as a pub-style tabletop game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno in addition to any of their bonus triggering events which trigger the gaming scheme of the present invention. In the preferred embodiment, the gaming device 10 incorporates a gaming scheme including a primary game and a secondary or bonus game. However, it should be appreciated that the gaming device 10 includes a primary game while the gaming scheme comprises only the secondary game. The symbols and indicia used on and in gaming device 10 may be in mechanical, electrical or video form. In one embodiment, the primary game uses symbols and indica in mechanical form and the secondary game includes only symbols in video form. It is also anticipated that the symbols in both the primary and secondary game are in video form.

Figure 1B:
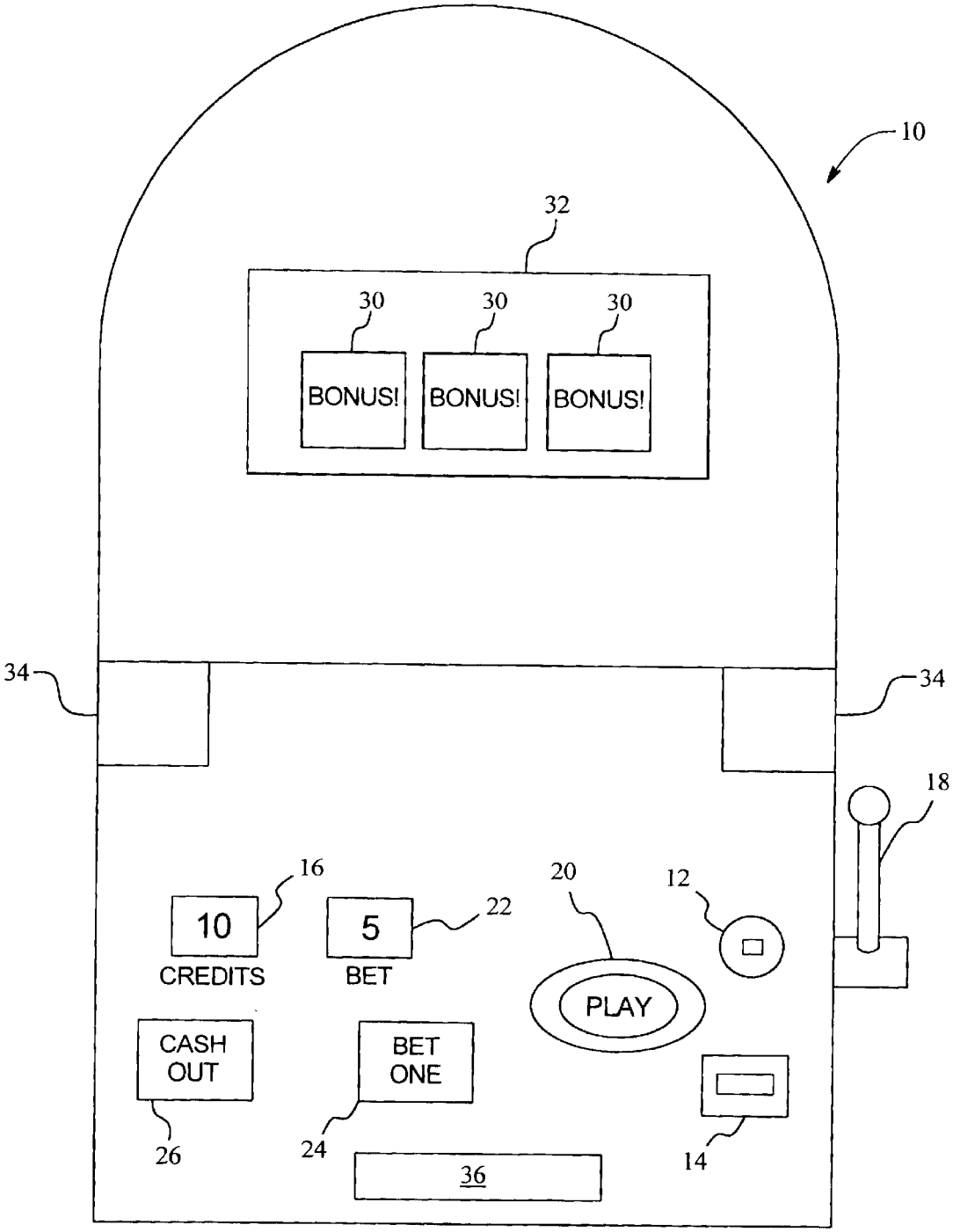

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used to accept payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism (including a touch screen) which starts the game.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably two to five reels in mechanical or video (i.e., virtual) form. Each reel 30 displays a plurality of indicia such as bells, hearts, fruits, numbers, letters, bars or other images which preferably correspond to a theme associated with the gaming device 10. Each symbol may be associated with an audio representation provided through speakers 34. If the reels 30 are in video or virtual form, the gaming device 10 preferably displays the video reels 30 at display 32 instead of at display window 28 (best viewed in FIG. 1B).

The display 32 is selected from the group consisting of cathode ray tubes "CRTs", high resolution flat panel LCDs, projection type LCDs, plasma displays, field emission displays, digital micromirror displays, LCD touch-screens, flat TV displays or other suitable displays. The display 32 is capable of portraying or displaying images, symbols and other indicia including images of people, characters, places, things and card faces associated with the game. This display 32 (and speakers 34) generally attract patrons to play the game.

In one preferred embodiment, the display 32 is an LCD which is used to display images, symbols and other indicia including secondary games which represent a bonus game (a secondary game for which a bonus is awarded to the primary game). It should be appreciated that the display window 28 containing reels 30 and display 32 could be combined into one display so that the display 32 provides the reels 30 only in video or virtual form along with the images, symbols and other indicia of the gaming device 10 for both the primary and secondary games (best viewed in FIG. 1B). Furthermore, a plurality of smaller displays could combine to form display 32 and used with the present invention.

At any time during the primary game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
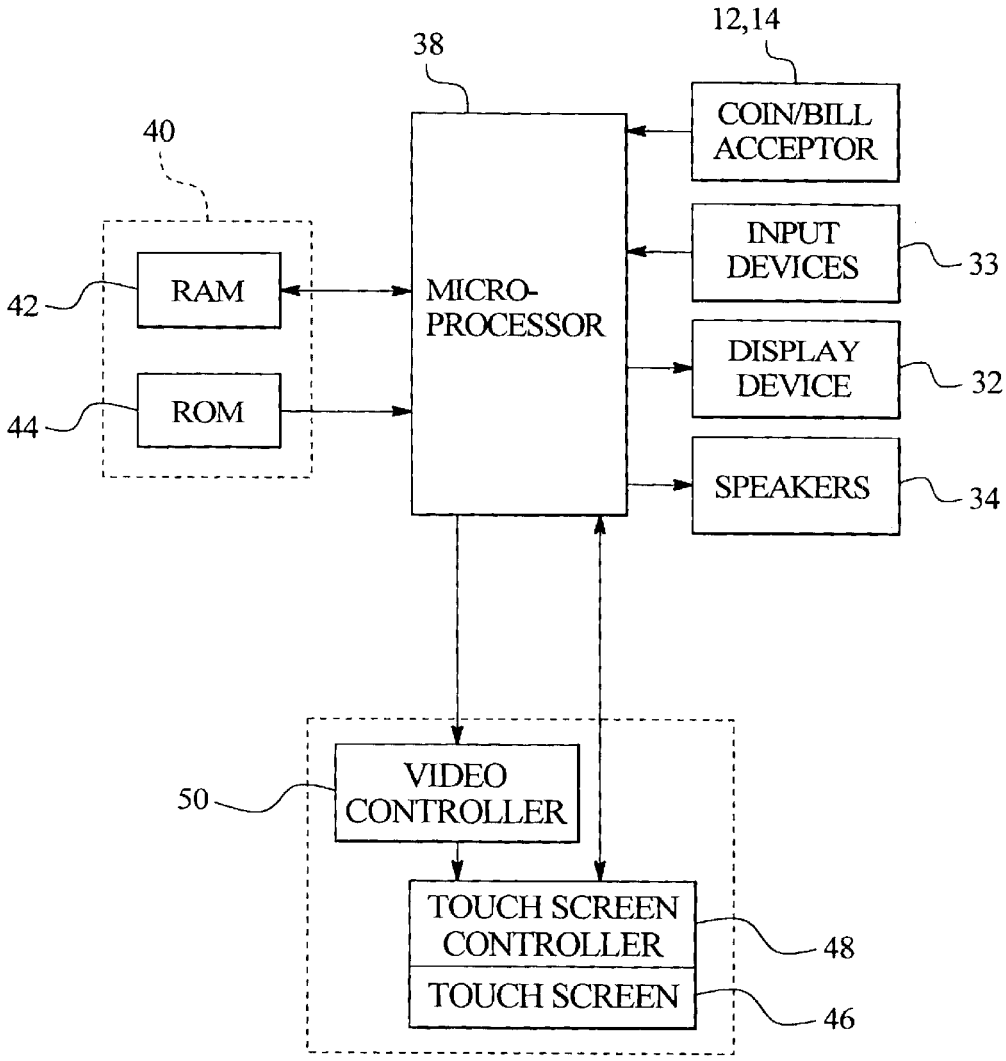
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a display 32 or other display device such as a liquid crystal display and at least one input device such as play button 20 in FIGS. 1A and 1B. The processor 38 is preferably a microprocessor or microcontroller-based platform which is capable of displaying images, symbols and other indicia such as images of people, characters, places, things and faces of cards. The processor 38 also provides the interaction between the images, symbols and other indicia, generally in cartoon form. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game scheme and any applicable pay tables.

The player preferably uses input devices 33 such as play button 20 or arm 18 as illustrated in FIG. 2, to input signals into gaming device 10. Furthermore, it is anticipated that gaming device 10 includes a touch screen 46 and an associated touch screen controller 48 since the game requires input or a selection by the player. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although the processor 38 and memory device 40 are preferable implementations of the present invention, the present invention can also be implemented using one or more application-specific integrated circuits (ASIC's) or other hard-wired devices, (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or "controller."

With reference to FIGS. 1A, 1B and 2, to operate the gaming device 10, the player must insert the appropriate amount of money or tokens at coin slot 12 or bill acceptor 14 and then activate the input device 33 (i.e., pull the arm 18, push the play button 20 or use touch screen buttons. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also provides players the opportunity to win credits in the secondary or bonus round. It should be anticipated that while the present invention is in regards to a bonus round, it is equally applicable to a primary game. This type of gaming device 10 includes a program which automatically begins a secondary or bonus round (i.e., the "gaming scheme") when the player has achieved a qualifying condition in the primary game. This qualifying condition can be a particular arrangement of indicia on the display window 28.

Preferably, the qualifying condition is a predetermined combination of indicia appearing on a plurality of reels 30. As illustrated in the three reel slot game shown in FIGS. 1A and 1B, the qualifying condition could be the text "BONUS" appearing in the same location on three adjacent reels during the primary game or the text "Bonus" on one reel and a predetermined bet in the primary game.

Gaming Scheme with Interacting Symbols

Figure 3:
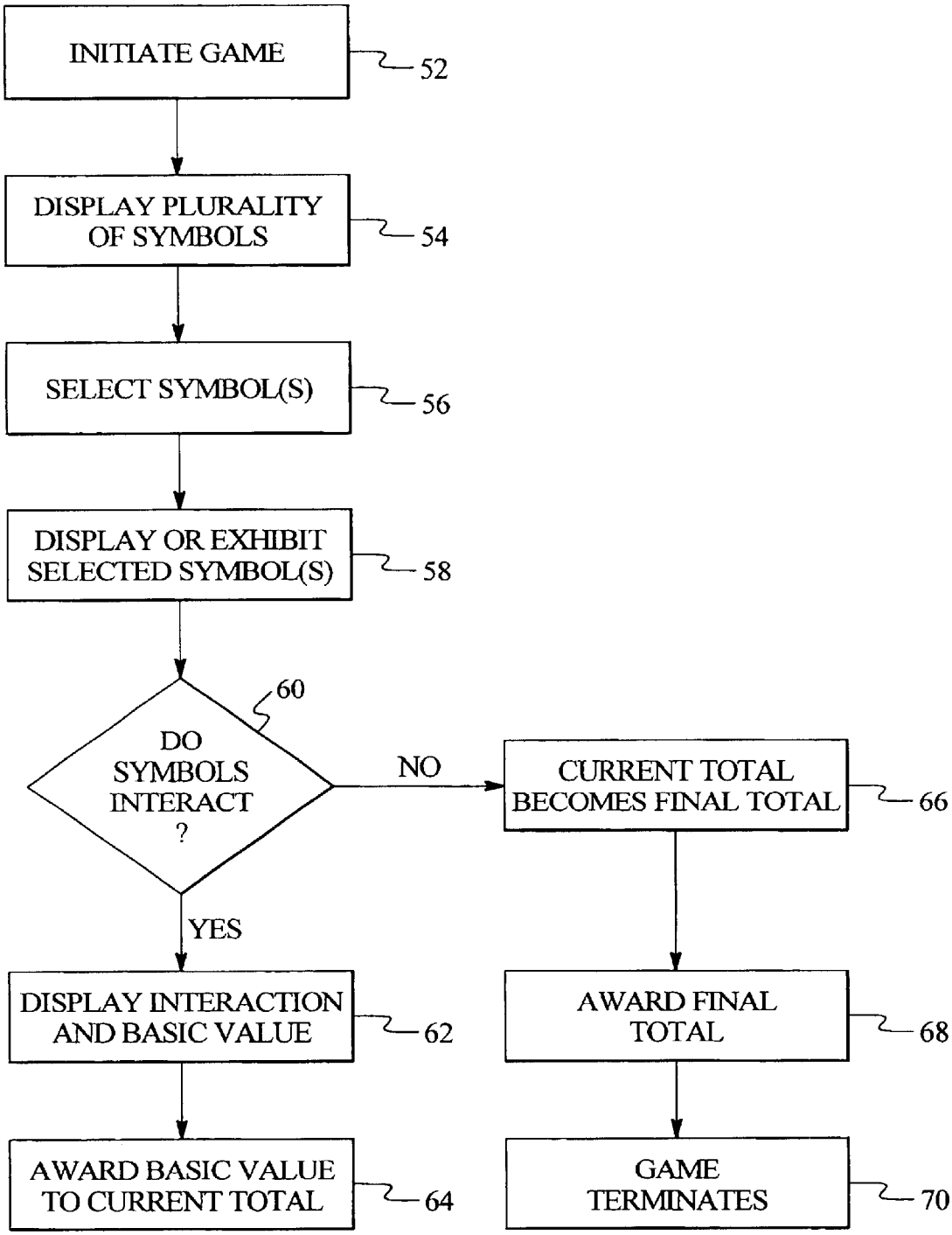
FIG. 3 is a flow diagram of one embodiment of the gaming scheme of the present invention.

If a player achieves a bonus triggering or qualifying condition while playing the primary game, the gaming device 10 automatically initiates the gaming scheme, beginning the bonus round of the present invention as indicated by block 52 in FIG. 3. The gaming scheme of the present invention provides the player with a plurality of symbols as indicated by block 54. The symbols are images consisting of varying graphics and having various sizes, shapes, colors and associated sounds.

In one embodiment of the present invention, the plurality of symbols are displayed on two or more video or virtual reels 30 (see FIG. 1B) provided by display 32. In one preferred embodiment, five video reels are contemplated, each reel having a plurality of symbols as illustrated in FIGS. 5A through 5G. However, it should be anticipated that three reels 30 provide the symbols in a grid-like arrangement as illustrated in FIGS. 4A through 4E. The symbols can be separated and spaced apart in an orderly or disorderly fashion.

In one embodiment, the gaming device 10 (see FIG. 1B) spins the reels 30, randomly rearranging or altering the position of the symbols. The gaming device 10 displays the rearranged symbols. If at least two or more preferably related symbols are adjacently positioned (i.e., horizontally, vertically or diagonally) the gaming device 10 displays the interaction between the symbols.

In another preferred embodiment, gaming device 10 spins the plurality of reels 30 prior to displaying the plurality of randomly rearranged symbols. After reviewing the plurality of symbols, the player chooses or selects at least one of the highlighted or indicated symbols (preferably by touching touch screen 46) as indicated by block 56 in FIG. 3. When a player selects an interacting symbol, the game exhibits, displays or otherwise causes the selected interacting symbol to interact with another interacting symbol as indicated by block 58. It is also contemplated that the player selects the first interacting symbol and then selects one or more additional interacting symbols that interact with the first symbol.

Preferably the selected symbols have related characteristics and interact because of those related characteristics. For example interacting symbols include: (i) a horse and buggy, where the interaction includes the horse pulling the buggy; (ii) a hammer and nail, where the hammer strikes the nail; and (iii) a cow and a moon, where the cow jumps over the moon.

The game preferably awards the basic value to the player each time the device 10 displays the interacting symbol(s). The values of the interacting symbols may vary, are preferably combined and are displayed to the player. It should be appreciated, however, that more than two symbols may interact and different values may be awarded depending on the symbols that are selected and the interaction between those symbols. For example, the gaming device 10 might display drumsticks, a drum and cymbals, where only the drumsticks and drum interact. The player only receives credit or bonus values when the device 10 displays or the player selects the drumsticks and drum. In one alternative embodiment, if the device displays or the player selects the drumsticks and cymbals (i.e., the non-interacting cymbals), the gaming device 10 does not display an interaction or award any credit value to the player.

In another example involving the same symbols (i.e., drumsticks, drum and cymbals), different credit values are awarded for different selections and interactions. For example, the gaming device 10 may display one interaction and award a predetermined credit value for displaying or selecting the interaction and different value for displaying or selecting the drumsticks and cymbals.

It should be appreciated that the non-interacting and interacting symbols are interchangeable. That is one symbol may interact with a second symbol in one game (i.e., the drumsticks and the drum) and with a different symbol in another game (i.e., the drumsticks and the cymbals). Further, non-interacting symbols in one game may become interacting symbols in another.

In this embodiment, the gaming device 10 determines if the symbols interact as indicated by diamond 60. If the symbols interact, the game preferably displays the interaction and the basic value associated with such interaction as indicated by block 62 and awards the player that basic or credit value as indicated by block 64. The game device 10 adds the basic or credit value to the player's current value which is preferably displayed by the display 32 or credit display 16, as indicated by block 64. In one embodiment the game further spins the reels, displays a new set of plurality of symbols and enables the player to play again.

If the machine does not display or the player does not select interacting symbols as indicated by diamond 60, the bonus round or game preferably ends. The player's current total as displayed in credit display 16 or display 32 becomes the final total which is awarded to the player as indicated by blocks 66 and 68 respectively. Preferably the gaming device 10 terminates the gaming scheme, terminating the bonus round (or primary game if applicable) as illustrated by block 70.

Figure 4A:
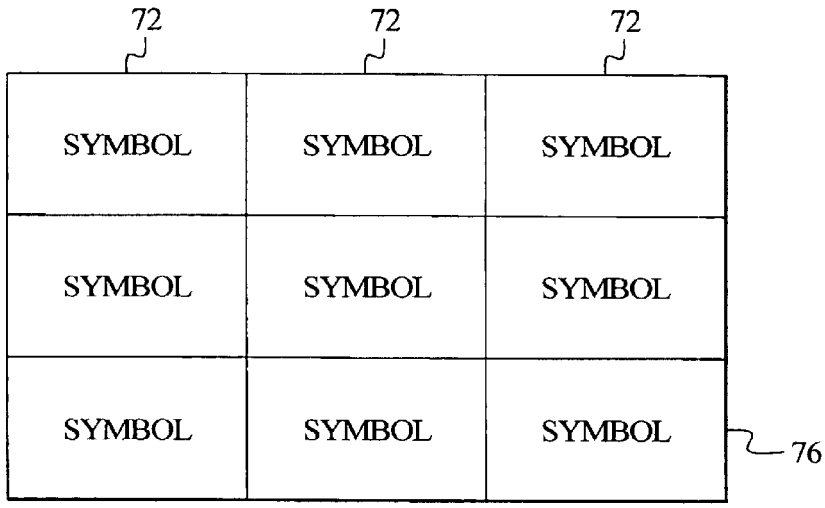
FIGS. 4A, 4B, 4C, 4D and 4E are top plan views of the selections, symbols and interaction in one embodiment of the gaming scheme of the present invention.

An embodiment of the game is illustrated in FIGS. 4A through 4E. The gaming device 10 displays a plurality of reels 72 having a plurality of symbols 74 that connect to, and are controlled by, the controller. In the depicted embodiment, the gaming device 10 displays three digital or virtual reels 72 which form a grid 76 as illustrated in FIG. 4A.

In one embodiment, the device 10 spins reels 72, rearranging or altering the arrangement of the symbols 74. If two (or more) symbols are aligned, preferably on a horizontal line, display 32 provides or displays the interaction 82 (best viewed in FIG. 4D) then displays the basic or credit value 84 (best viewed in FIG. 4E).

Figure 4B:
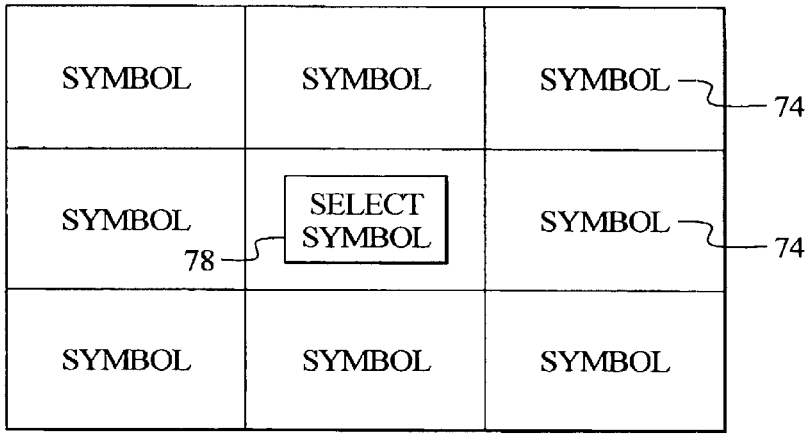
Figure 4C:
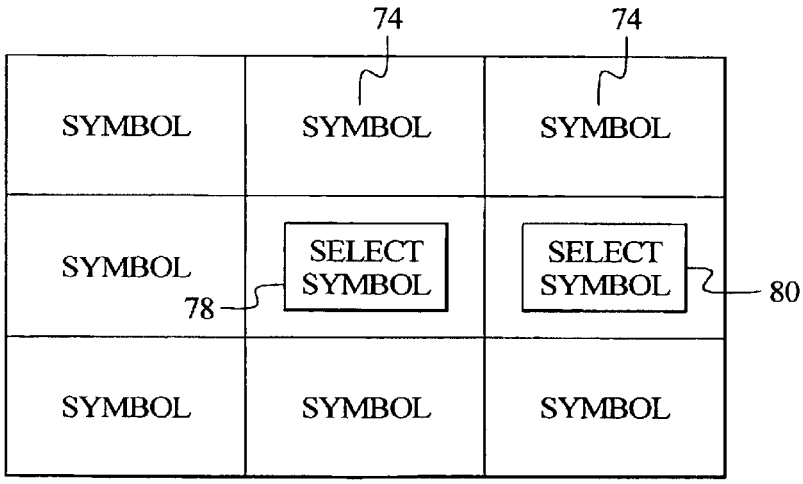

In another embodiment, device 10 selects a symbol 74 and displays that selection as a first or displayed symbol 78 as illustrated in FIG. 4B. The gaming device 10 prompts the player to select a matching or interacting symbol 80 as illustrated in FIG. 4C using visual or audio prompts or a combination of the two. The visual prompts are provided by display 32 while the audio prompts are provided by speakers 34. It should also be anticipated that the gaming device prompts the player to select the first symbol 78 and then selects the interacting symbol 80.

Figure 4D:
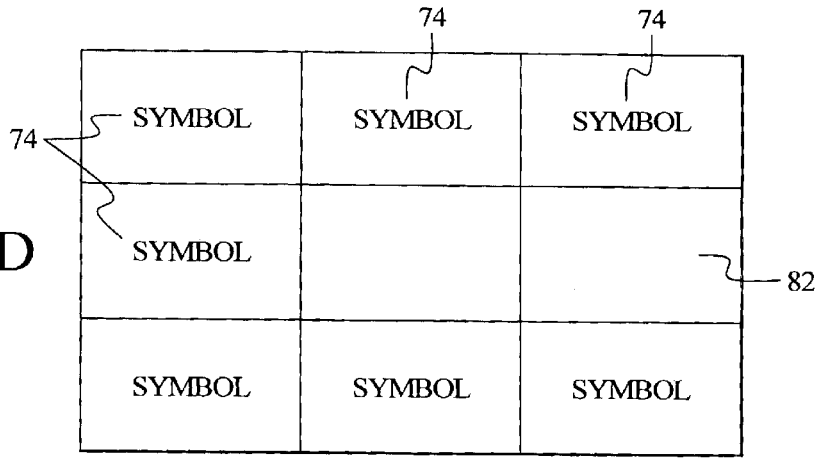
Figure 4E:
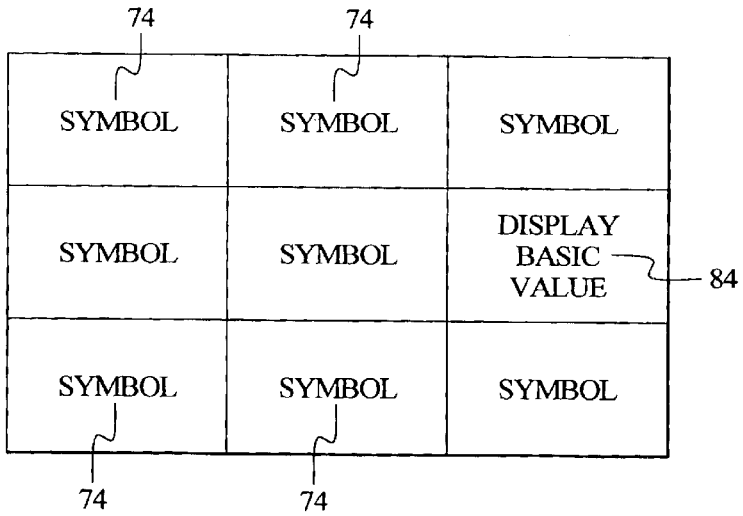
Figure 5A:
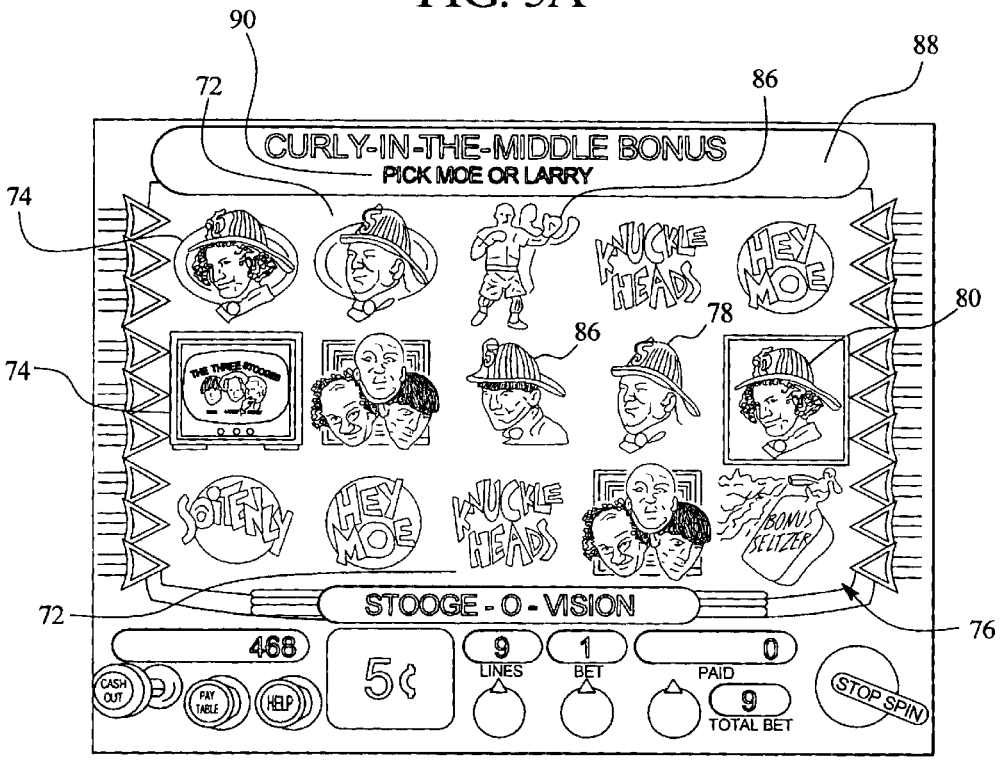
FIGS. 5A, 5B, 5C, 5D, 5E, 5F and 5G are a top plan views of an alternative embodiment of the selections, symbols and interactions of the gaming scheme of the present invention.
Figure 5B:
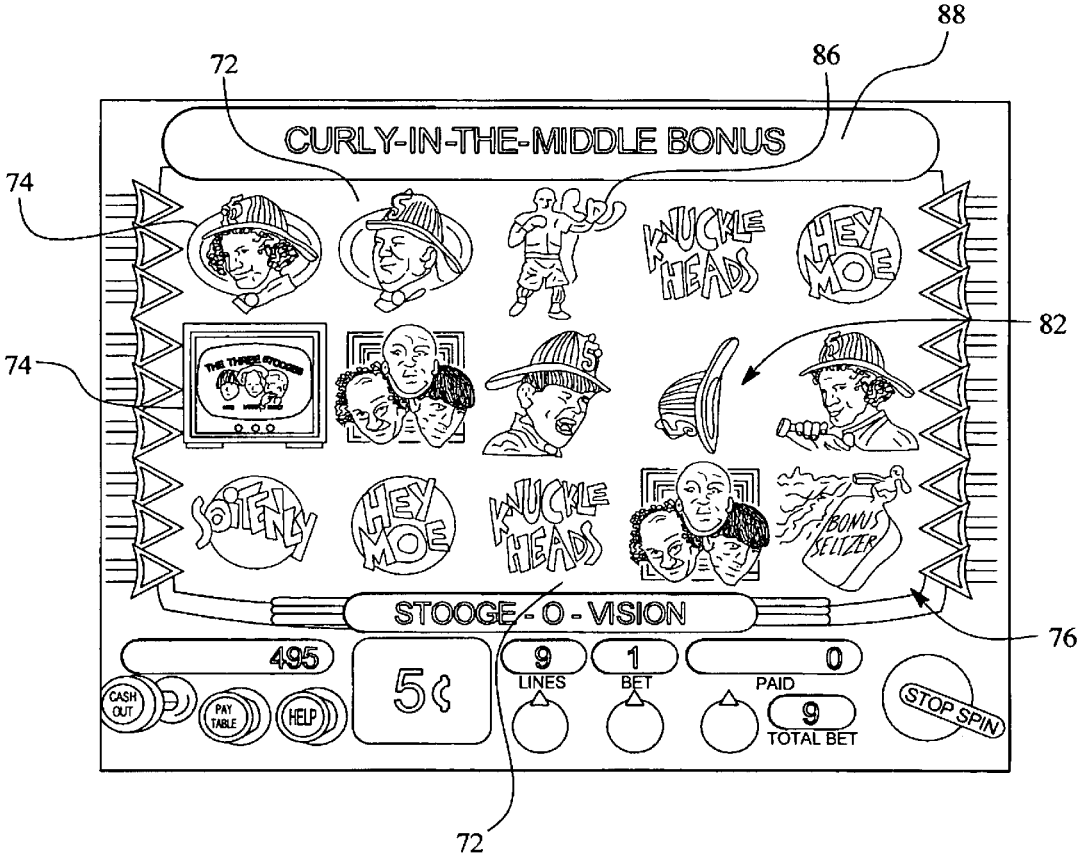
Figure 5C:
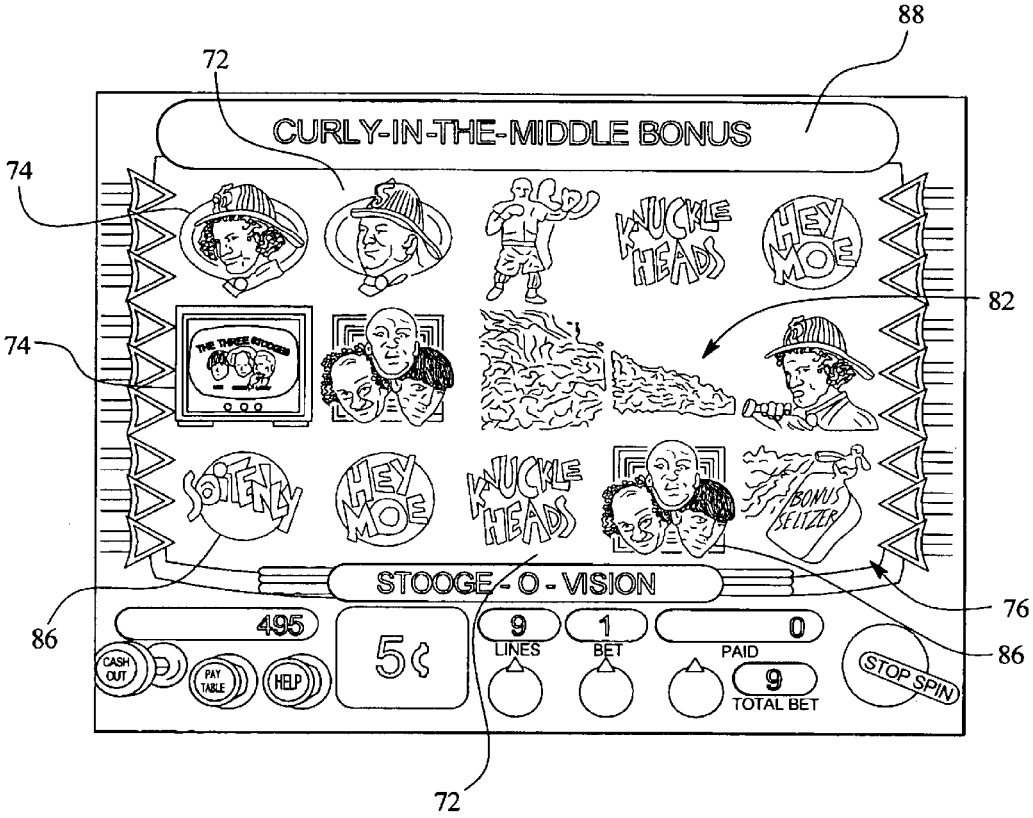
Figure 5D:
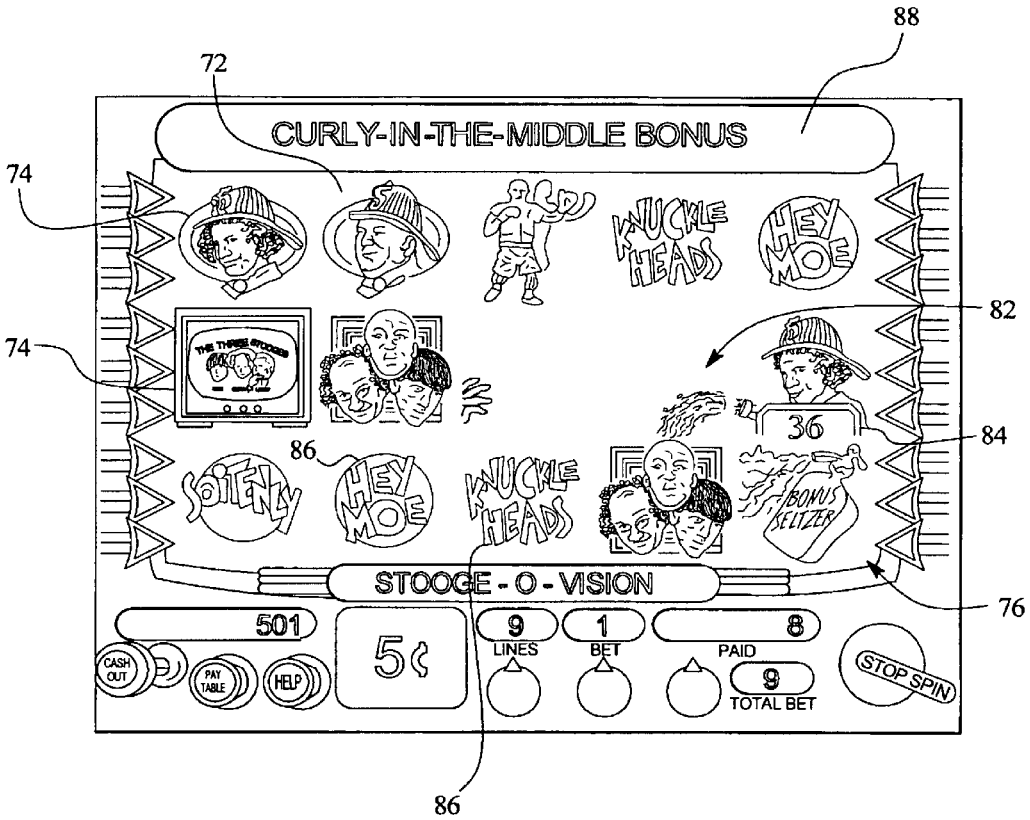
Figure 5E:
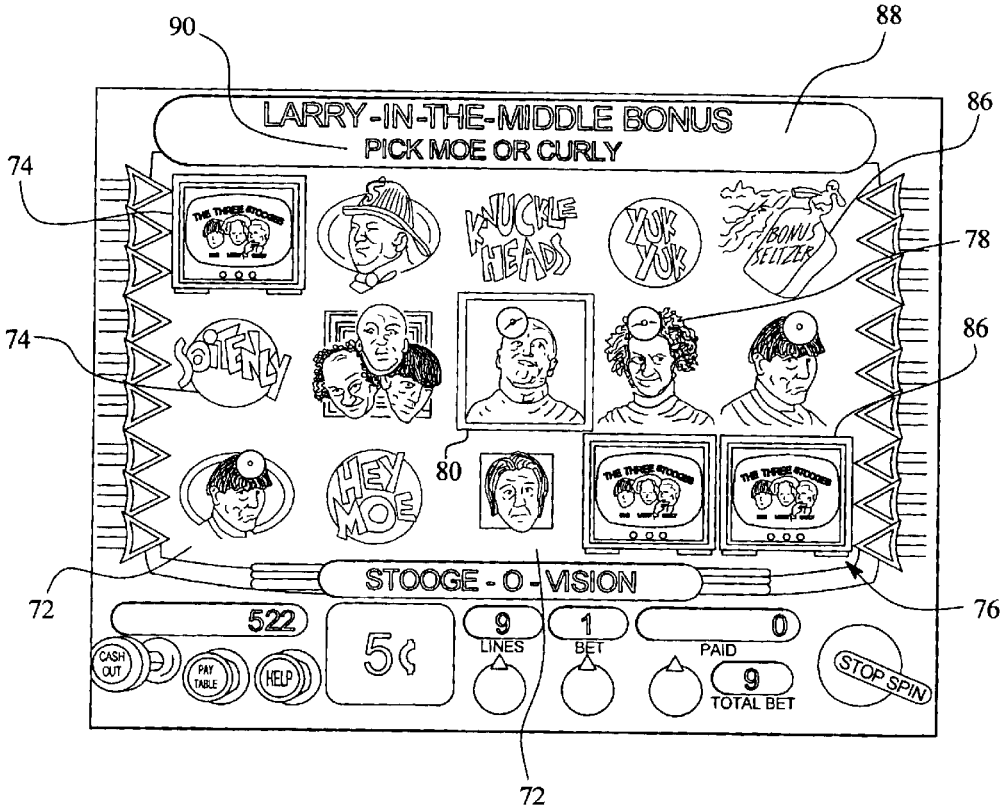
Figure 5F:
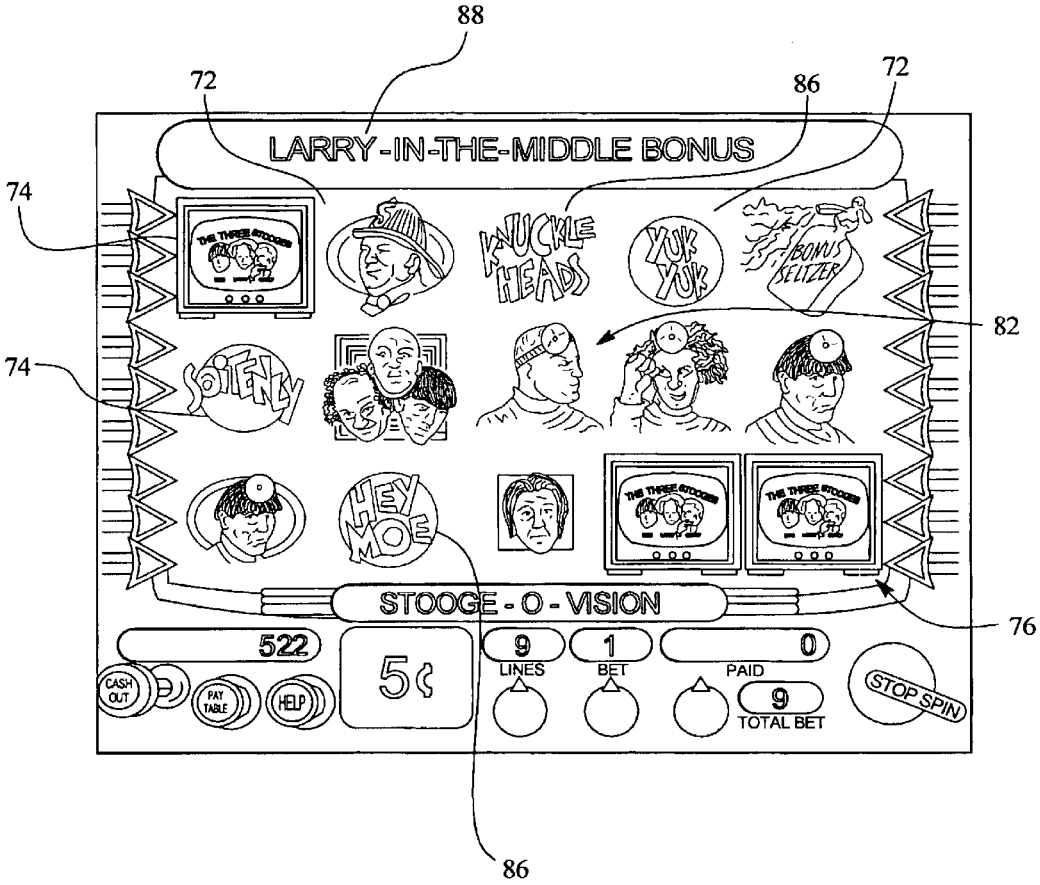
Figure 5G:
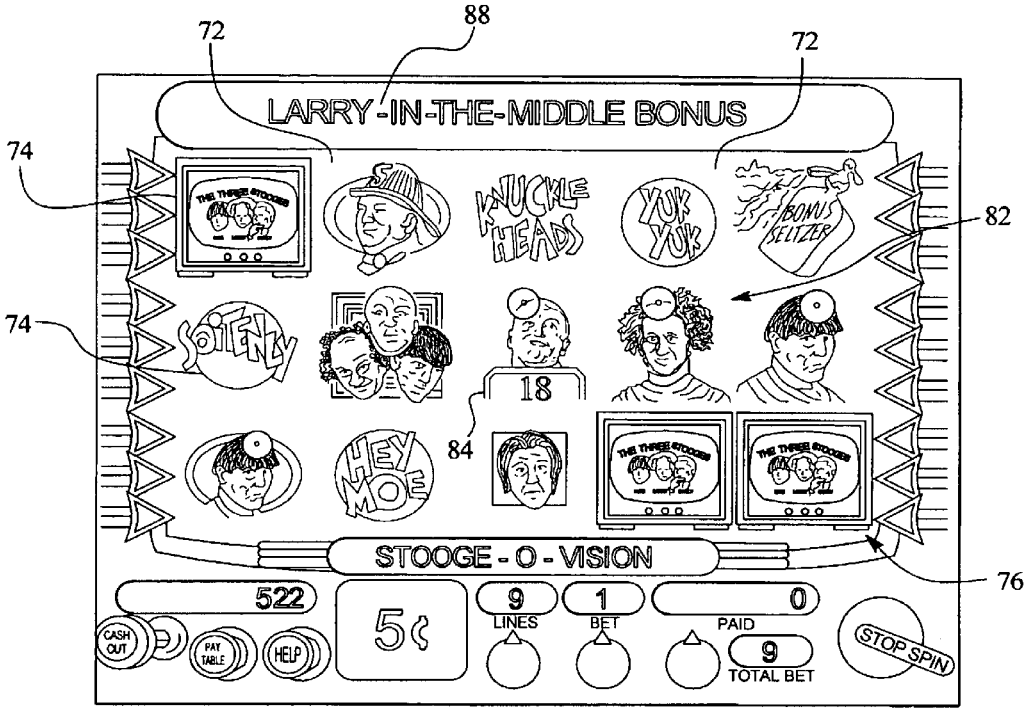

If the player has chosen correctly (i.e., chosen symbols that interact) the display 32 displays the interaction 82 and then the credit value 84 associated with that interaction as illustrated in FIGS. 4D and 4E. The game adds the credit value to the player's current value and starts the game or round over, spinning the reels 72 and prompting the player to select a new symbol(s). If the symbols 74 do not interact, the game terminates.

Preferably the game device 10 rearranges the symbols each time a new bonus round begins. The rearrangement enables the symbols 74 to be located in different locations from play to play in one bonus round or from bonus round to bonus round.

The bonus scheme of the present invention offer players with a heightened level of excitement because the player does not know what basic values are "behind" the interacting symbols. The game offers the player an array of symbols. When the device 10 displays or the player chooses a symbol, the device 10 could display or the player could select a symbol which is related to and interacts with another symbol, providing the player with a basic value. The possibility that one spin or one touch on touch screen 44 could bring instant failure or success with various awards is exciting and generally pleasurable to players. Moreover the contemplated interaction is preferably silly, providing enjoyment to the player.

In one preferred embodiment of the present invention, the symbols in the gaming scheme of the present invention are images, specifically, characters. The characters are people and animals, preferably in cartoon form. Furthermore, in this preferred embodiment certain characters are related.

As is apparent by viewing FIGS. 5A through 5G, one embodiment of the bonus scheme preferably, incorporates a Three Stooges cartoon theme, including Three Stooges characters. Three Stooges is a registered trademark of C3 Entertainment, Inc., and is licensed by the assignee of the present invention. In addition, the preferred embodiment can include audio features (i.e., songs, voices and other sound effects) which are consistent with the cartoon theme of this preferred embodiment.

The five reels 72 illustrated in FIGS. 5A through 5G include a plurality of Three Stooges characters 86. The symbols 74 are shaped in squares and located on a three by five grid 76. The reels 72 or a box adjacent to the reels include a message 88 to the player.

The game prompts the player to select an interacting symbol, using a visual prompt 90 and/or an audio prompt using speaker 34. After selecting the interacting symbol 80, the game displays the interaction 82 as illustrated in FIGS. 5B, 5C, 5D and 5F and provides the associated credit or basic value 84 (best seen in FIGS. 5D and 5G). In the depicted embodiments, one interacting symbol 80 illustrated in FIG. 5A squirts a fire hose at another interacting symbol and one interacting symbol 80 illustrated in FIG. 5A pulls another interacting symbol's hair.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device having a game, said gaming device comprising:

a controller;

a plurality of reels having a plurality of interacting reel symbols positioned on a plurality of locations on the reels;

an image of a first one of the interacting reel symbols while on a first one of the locations interacting with a second one of the interacting reel symbols while on a second one of the locations, the image extending from the first location to the second location, the image including a variation of the first interacting reel symbol and a variation of the second interacting reel symbol;

means controlled by the controller for enabling the player to select one of the interacting reel symbols; and a display device controlled by the controller and adapted to display: (a) the reels during the game; and (b) the image after a player selects one of the interacting reel symbols.

2. The gaming device of claim 1, which includes an award provided to the player which is associated with at least one of the interacting reel symbols.

3. The gaming device of claim 1, which includes an award associated with each interacting reel symbol, wherein said award associated with the selected interacting reel symbol selected by the player is provided to the player.

4. The gaming device of claim 1, wherein the reels include a plurality of sets of interacting reel symbols, wherein each interacting reel symbol in each set interacts with at least one other interacting reel symbol in said set.

5. The gaming device of claim 1, wherein the reels first interacting reel symbol is located on one of the reels which is non-adjacent to the reel upon which the second interacting reel symbol is located.

6. The gaming device of claim 1, which includes at least three interacting reel symbols, wherein upon a generation of said three interacting reel symbols on the reels, at least two of said interacting reel symbols are player selectable.

7. A method for operating a gaming device having a gaming scheme with a plurality of symbols including at least two player selectable interacting symbols on a plurality of reels, said method comprising the steps of:

(a) randomly generating and displaying a plurality of said symbols on different locations on the reels;

(b) enabling a player to select one of the interacting symbols if at least two interacting symbols are randomly generated and displayed on the locations on the reels;

(c) displaying an image of said selected interacting symbol while on one of the locations interacting with the other interacting symbol while on another one of the locations, the image extending from the location of the selected interacting symbol to the location of said other interacting symbol; and (d) providing an award to the player which is associated with the selected interacting symbol.

8. The method of claim 7, wherein the awards associated with each of the interacting symbols are randomly selected from a plurality of awards.

9. The method of claim 7, wherein the step of enabling the player to select one of the interacting symbols includes enabling the player to select one of the interacting symbols when at least two of the interacting symbols are displayed on a payline associated with the reels.

10. The method of claim 7, wherein the step of enabling the player to select one of the interacting symbols includes enabling the player to select two of the interacting symbols when the interacting symbols are displayed on a payline and the award is based on the interacting symbols selected by the player.

11. The method of claim 7, wherein the step of enabling the player to select one of the interacting symbols includes enabling the player to select at least one interacting symbol when two interacting symbols are generated on adjacent reels.

12. The method of claim 7, wherein the step of enabling the player to select one of the interacting symbols includes enabling the player to select at least one interacting symbol when two interacting symbols are generated on non-adjacent reels.

13. The method of claim 7, which includes prompting the player to select one of the interacting symbols.

14. The method of claim 7, which includes audibly prompting the player to select one of the interacting symbols.

15. A gaming device comprising:

a display device;

a game including a plurality of reels displayed by the display device;

a plurality of reel symbols positioned adjacent to one another on different locations on the reels, at least one of the reel symbols selectable by a player;

an image of a first one of the reel symbols interacting with a second one of the reel symbols, the image extending from a first one of the locations to a second one of the locations, the image including at least a portion of the first reel symbol positioned on the first location and at least a portion of the second reel symbol positioned on the second location; and a processor which controls the display device, said processor operable to: (a) cause the display device to display the reels during the game; (b) enable the player to select one of the reel symbols; and (c) cause the display device to display the image after the player selects said reel symbol.

16. The gaming device of claim 15, wherein the award provided to the player includes an award associated with the first reel symbol or the second reel symbol.

17. The gaming device of claim 15, wherein the first reel symbol and the second reel symbol are positioned on adjacent reels.

18. The gaming device of claim 15, wherein the first reel symbol and the second reel symbol are positioned on non-adjacent reels.

19. The gaming device of claim 15, wherein the image includes a third reel symbol interacting with the first reel symbol and the second reel symbol after said reel symbols are randomly generated on a payline on the reels and after the player selects one of the reel symbols.

20. A gaming device comprising:

a display device;

a plurality of reels displayed by the display device;

a plurality of reel symbols positioned on a plurality of locations on the reels, at least one of the reel symbols selectable by a player;

an image of a first one of the reel symbols while on a first one of the locations interacting with a second one of the reel symbols while on a second one of the locations wherein one of the interacting reel symbols is selectable, the image extending from the first location, across a designated reel, to the second location, the image constructed of the first reel symbol, a designated image on the designated reel and the second reel symbol; and a processor which controls the display device, said processor operable to cause the display device to display: (a) the reels during the game; and (b) the image after the player selects one of the reel symbols.

21. The gaming device claim 20, which includes a payline associated with the reels, wherein said processor is operable to cause the display device to display the first reel symbol and the second reel symbol interacting with each other on said payline after said interacting reel are randomly generated.

22. The gaming device claim 20, wherein the first reel symbol and the second reel symbol are both player selectable.

23. The gaming device claim 22, which includes an award provided to the player, said award associated with one of the reel symbols selected by the player.

24. A gaming device comprising:

a display device;

a game including a plurality of reels displayed by the display device;

a plurality of symbols having locations on said reels, said symbols including a plurality of non-interacting symbols and at least two interacting symbols, at least one of the interacting symbols selectable;

a payline associated with the reels;

an image of one of the interacting symbols on one of the locations interacting with another one of the interacting symbols on another one of the locations, the image including a variation of at least one of the interacting symbols;

at least one input device operable to enable a player to select one of the reel symbols; and a processor which controls the display device, said processor operable to: (a) cause the display device to display the reels during the game; (b) cause the display device to display the single image after the player selects one of the reel symbols; and (c) provide an award to the player associated with at least one of the interacting reel symbols.

25. The gaming device of claim 24, wherein a plurality of the interacting symbols are player selectable, and the processor is operable to enable the player to select at least one of the interacting symbols when said interacting symbols occur on the payline associated with the reels.

26. The gaming device of claim 25, wherein the award provided to the player is an award associated with the interacting symbol selected by the player.

27. The gaming device of claim 24, wherein the display device includes a touch screen.

28. A gaming device comprising:

a display device;

a game including a plurality of reels displayed by the display device;

a plurality of symbols on said reels, said symbols including a plurality of non-interacting symbols and a plurality of interacting symbols;

an award from a plurality of awards associated with each different pair of interacting symbols generated on different locations on the reels;

an image of a first one of the interacting symbols while on a first one of said locations interacting with a second one of the interacting symbols while on a second one of said locations, the image including a variation of said first interacting symbol, the image extending from the first location to the second location; and a processor which controls the display device, said processor operable to: (a) cause the display device to display the reels during the game; (b) cause the display device to display the image of said first interacting symbol interacting with said second interacting symbol; and (c) provide the award associated with said first and second interacting symbols to the player.

29. The gaming device of claim 28, wherein the award provided to the player is a randomly generated award associated with one of the interacting symbols which is selected by the player.

30. A gaming device comprising:

a display device;

a game including a plurality of reels displayed by the display device;

a plurality of symbols on locations on said reels, said symbols including a plurality of non-interacting symbols and a plurality of player selectable interacting symbols on non-adjacent reels;

an image of a first one of the player selectable interacting symbols while on a first one of the locations interacting with a second one of the player selectable interacting symbols while on a second one of the locations, the image including a variation of at least one of said player selectable interacting symbols, the image extending from the first location, across one of the reels, to the second location;

a payline associated with the reels; and a processor which controls the display device, said processor operable to enable a player to select one of the selectable interacting symbols when said interacting symbols are randomly generated on non-adjacent reels, cause the display device to display said selected interacting symbol interacting with another of said interacting symbols, and provide an award to the player associated with said selected interacting symbol.

31. A method for operating a gaming device having a plurality of symbols on a plurality of reels, said method comprising the steps of:

(a) randomly determining and displaying a plurality of the symbols on locations on the reels;

(b) enabling a player to select one of the symbols on a first one of the locations;

(c) forming an image of the selected symbol interacting with a different one of the symbols by: (i) graphically changing the selected symbol while the selected symbol is positioned on the first location; and (ii) graphically changing the different symbol while said different symbol is on a different one of the locations; and (d) providing an award to a player associated with the selected symbol or said different symbol.

32. The method of claim 31, which includes enabling the player to select one of the randomly generated interacting symbols.

33. The method of claim 31, wherein the award is based on the interacting symbol selected by the player.

34. A gaming device operable under control of a processor, the gaming device comprising:

a game operable upon a wager by a player, said game including a plurality of reels a plurality of symbols at positions on the reels, said symbols including a first symbol at a first position on one of the reels and a second symbol at a second position on one of the reels;

an image of the first symbol while at the first position interacting with the second symbol while at the second position, the image including at least a variation of one of the first symbol and the second symbol, the image extending from the first position to the second position;

a game outcome associated with at least one of the symbols; and a display device which, following at least one event in the game, is operable to display the reels, the symbols and the image.

35. The gaming device of claim 34, wherein the variation includes a removal of a portion of the first symbol or the second symbol.

36. The gaming device of claim 34, wherein the variation includes an addition of a portion of the first symbol or the second symbol.

37. The gaming device of claim 34, wherein the image includes a designated symbol positioned between the first symbol and the second symbol, wherein the display device is operable to display: (a) the reels and the symbols following a first event; and (b) the image including the designated symbol following a second event.

38. A gaming device comprising:

a display device;

a slot game including a plurality of reels displayed by the display device;

a plurality of symbols on said reels, said symbols including a plurality of non-interacting symbols and a plurality of interacting symbols, wherein at least one set of the interacting symbols are at positions on different reels;

an award associated with said set of interacting symbols; and a processor operable with the display device: (a) to display the reels and symbols on the reels during the game; (b) upon a generation and display of the set of interacting symbols on different reels during the game, display a first image from a first one of said interacting symbols at a first one of the positions on a first one of the reels interacting with at least a second image from a second one of said interacting symbols at a second one of the positions on a second one of said reels; and (c) after said display, provide the player the award associated with said set of interacting symbols.

39. The gaming device of claim 38, wherein the first image includes a variation of the first interacting symbol.

40. The gaming device of claim 38, wherein the second image includes a variation of the second interacting symbol.

41. A gaming device comprising:

a display device;

a slot game including a plurality of reels displayed by the display device;

a plurality of symbols on said reels, said symbols including a plurality of non-interacting symbols and a plurality of interacting symbols, wherein at least one set of the interacting symbols are on different reels;

an award associated with the set of interacting symbols; and a processor operable with the display device: (a) to display the reels and symbols on the reels during the game; (b) upon a generation and display of the set of interacting symbols on different reels during the game, display a first image from a first one of said interacting symbols on a first one of the reels interacting with at least a second image from a second one of said interacting symbols on a second one of said reels, the first image extending from the first interacting symbol to the second interacting symbol; and (c) after said display, provide the player the award associated with said set of interacting symbols.

42. The gaming device of claim 41, wherein the first interacting symbol has a location on the first reel.

43. The gaming device of claim 42, wherein the first image has a portion which extends from the location of the first interacting symbol to the second image.

44. The gaming device of claim 41, wherein the first image includes a variation of the first interacting symbol.

45. The gaming device of claim 41, wherein the second image includes a variation of the second interacting symbol.

* * * * *